United States Patent [19]

Itoi

[11] 4,347,629

[45] Sep. 7, 1982

[54] OUTERWEAR USED BOTH AS JACKET AND BAG

[76] Inventor: Toru Itoi, 861-11, Komatsuri-cho, Kishiwada-shi, Osaka, Japan

[21] Appl. No.: 200,966

[22] Filed: Oct. 27, 1980

[51] Int. Cl.[3] ..... A41D 1/02; A45C 3/04

[52] U.S. Cl. ..... 2/108; 2/69.5; 2/126; 150/1.7

[58] Field of Search ..... 2/108, 126, 69.5, 94, 2/84, 88, 85; 150/1.7, 11, 1

[56] References Cited

U.S. PATENT DOCUMENTS

| | | | |
|---|---|---|---|
| 586,132 | 7/1897 | Lane | 2/88 |
| 1,284,352 | 11/1918 | Jasinski | 2/85 |
| 1,520,963 | 12/1924 | Nyilas | 2/84 |
| 2,382,396 | 2/1948 | Carlu | 2/88 |
| 2,469,700 | 5/1949 | Petrucelli | 2/69.5 |
| 2,959,789 | 11/1960 | Mills et al. | 2/93 |
| 3,013,274 | 12/1961 | Dike | 2/69 |
| 3,633,215 | 1/1972 | Richardss | 2/69.5 |
| 4,067,066 | 1/1978 | Bruno | 2/69.5 |
| 4,261,059 | 4/1981 | Spitz | 2/108 |

*Primary Examiner*—Doris L. Troutman

*Attorney, Agent, or Firm*—McAulay, Fields, Fisher, Goldstein & Nissen

[57] ABSTRACT

Disclosed is new combination garment useful both as a jacket and a bag having a trunk portion for covering the upper half of a human body, and formed with an opening through which a human head passes, sleeve portions through which both arms extend sideways and a head portion detachably secured to the trunk portion, in which the human head is received. When using the trunk portion as a bag, the sleeve portions are received in the trunk portion so that any part of the sleeve portions which doesn't protrude outside and the openings through which the arms and head pass are closed.

The first opening is formed at the joint between the trunk portion and sleeve portion so that the latter is received in the former through the first opening. The first opening can be closed by means of a fastener which is operated after receiving the sleeve portions in the trunk portion. In the meanwhile, the second opening is formed at the joint between the trunk portion and head portion and can be closed by a hook device. When the trunk portion is filled with small-sized goods, it is carried with the both first and second opening closed.

9 Claims, 10 Drawing Figures

OUTERWEAR USED BOTH AS JACKET AND BAG

BACKGROUND OF THE INVENTION

1. Field of the Invention

The present invention relates to a combination garment used both as jacket and bag. It more particularly relates to a garment which is used as a casual winter jacket or the like, or as a carrying bag or knapsack with both sleeve portions and a head portion received in a trunk portion.

2. Description of the Prior Art

Hitherto a number of outerwears with sleeves were already proposed for utilizing the outerwear as a carrying bag in which small-sized goods are contained. However, it is recognized as drawbacks with the conventional outerwears that small-sized goods often fall down through the sleeves and that they have an unpleasant appearance because of the fact that the sleeves are visible from the outside.

SUMMARY OF THE INVENTION

Thus it is the first object of the present invention to provide a combination garment useful both as a jacket and a bag which is designed in such a manner as to close openings at the joints between the trunk portion and sleeve portion as well as between the trunk portion and head portion so that nothing falls down therethrough.

It is the second object of the present invention to provide a combination garment used both as a jacket and a bag which is designed in such a manner as to receive the sleeve portions in the trunk portion when using it as a bag so that any part of the sleeve portions is invisible.

It is the third object of the present invention to provide an outerwear used both as a jacket and a bag which is designed such that it is carried on a human back by means of string means which serve also for closing the bottom edge of the trunk portion, when using it as a bag.

BRIEF DESCRIPTION OF THE ACCOMPANYING DRAWINGS

Other objects and advantageous features of the present invention will be apparent from the following description with reference to the accompanying drawings which illustrate preferred embodiments of the invention.

DETAILED DESCRIPTION OF PREFERRED EMBODIMENTS

Figure 5:
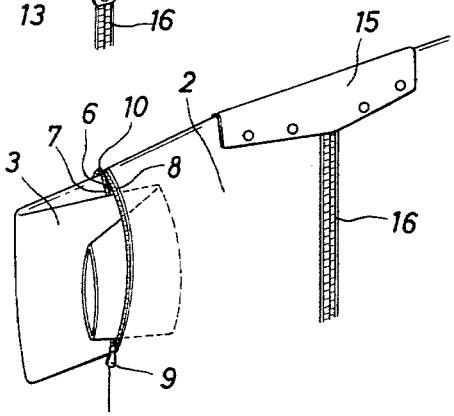
FIG. 5 is a perspective view of a part of the outerwear similar to FIG. 4, wherein the sleeve portion is partly received in the trunk portion.
Figure 6:
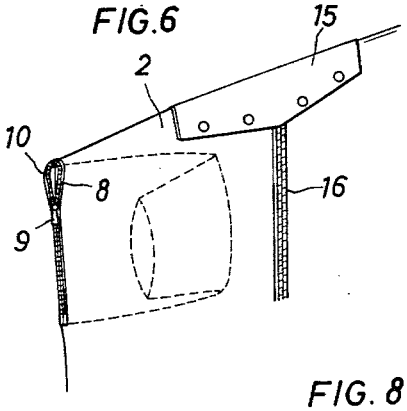
FIG. 6 is a perspective view of a part of the outerwear similar to FIG. 5, wherein the sleeve portion is completely received in the trunk portion.
Figure 7:
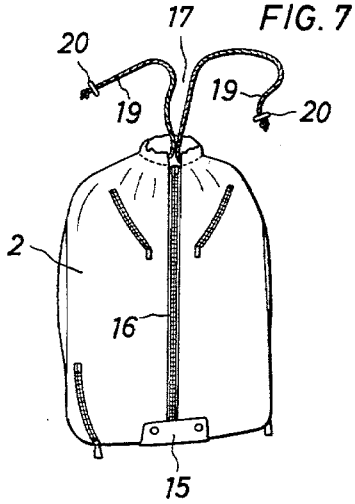
FIG. 7 is a perspective view of the outerwear in the form of a bag, wherein both end parts of a string are partly drawn out from the bottom part of the trunk portion.
Figure 8:
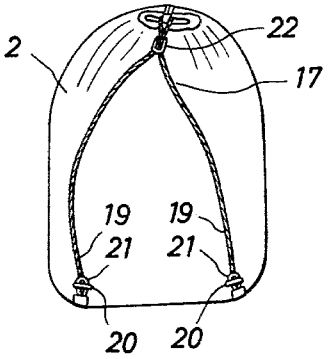
FIG. 8 is a perspective view of the outerwear similar to FIG. 7, wherein the both end parts of the string are completely drawn out and joined to the trunk portion in position at the upper part thereof.

As illustrated in FIGS. 1 through 4, the combination garment 1 used both as a jacket and carrying bag in accordance with the present invention essentially comprises a trunk portion 2 for the upper part of a human body, sleeve portions 3 and a head portion 4. A joint 5 between the sleeve portion 3 and trunk portion 2 has an open part at its front side which has no stitching. Specifically, the first opening 6 of the joint 5 can be closed by uniting track 7 at the sleeve portion 3 and track 8 with the aid of a slider 9. Thus the sleeve portion 3 can be received in the trunk portion 2 through the first opening 6 of the joint 5 by separating the both fastener tracks 7 and 8 and then expanding the first opening 6 of the joint 5, as illustrated in FIG. 5. It is to be noted that other fastener tracks 10 are provided at the rear part of the joint between the sleeve portion 3 and trunk portion 2. After the sleeve portion 3 is completely received in the trunk portion 2 through the first opening 6 of the joint 5, as illustrated in FIG. 6, both fastener tracks 7 and 8 are fastened again by means of the slider 9 so that any protrusion of the sleeve portion 3 is prevented.

The trunk portion 2 is formed with a second opening 11 through which a human neck passes, and the head portion 4 is stitched to the rear rim of the second opening 11 at its lower central part. The head portion 4 is provided with a plurality of hooks 12 along the inner side of the end part thereof, said hooks 12 being adapted to be engaged with other hooks 13 provided along the rim of the second opening 11, whereby the head portion 4 is firmly secured to the trunk portion 2. After disengaging the hooks 12 from the hooks 13, the head portion 4 can be received in the trunk portion 2 through the second opening 11. The head portion 4 is provided with a cover sheet 15 having a plurality of hooks 14 secured thereto. By receiving the head portion 4 in the trunk portion 2 through the second opening 11 and then engaging the hooks 14 with the hooks 13, the second opening 11 can be closed with the cover sheet 15, as illustrated in FIG. 5.

Further the trunk portion 2 is provided with a fastener 16 for the purpose of opening and closing the fore part of the trunk portion 2, said fastener 16 extending along the center line of the trunk portion 2 in the vertical direction.

Figure 1:
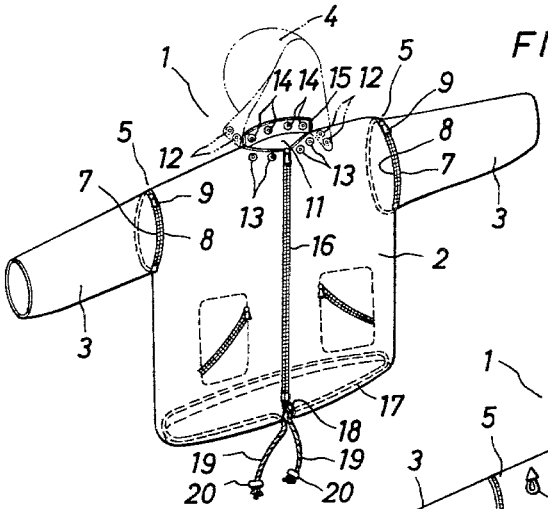
FIG. 1 is a perspective view of an outerwear garment used both as jacket and bag in accordance with an embodiment of the present invention, seen from the front.
Figure 2:
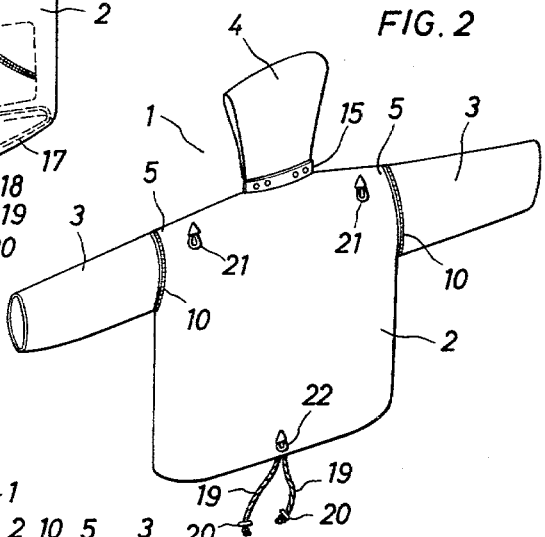
FIG. 2 is a perspective view of the outerwear of FIG. 1 seen from the rear.
Figure 3:
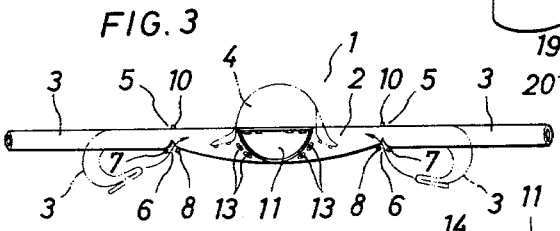
FIG. 3 is a plan view of the outerwear of FIG. 1.
Figure 4:
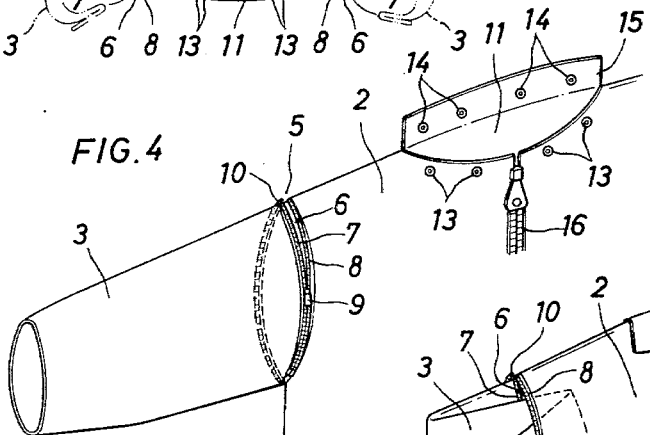
FIG. 4 is a perspective view of a part of the outerwear, shown in an enlarged scale, wherein the sleeve portion is protruded outwards from the trunk portion.

Along the bottom end of the trunk 2 is a casing forming a continuous tube 18 through which a draw string 17 isextended. The both end portions 19 of the string 17 are drawn out from the lower central part of the trunk portion 2 at its front side and they have a small rod or ring engagement piece 20 secured at their outer ends. As illustrated in FIG. 2, the trunk portion 2 is provided with two upper loop members 21 and a lower loop member 22 on the back side, each of which comprises a looped string, the former being symmetrically located at the upper part of the back of the trunk portion 2, while the latter being located at the lower central part in the vicinity of the bottom end thereof.

The article of the invention can be used as a bag in the form of knapsack, in the following manner.

First, turn over the trunk portion 2 upside down and then fill it with small-sized goods. Bring both end parts 19 of the string 17 toward the rear side of the trunk portion 2, allow them to pass through the lower loop member 22 and then anchor the engagement pieces 20 at the upper loop members 21. Now the article is ready to be used as a knapsack.

The article of the invention can be used as a casual winter jacket also in the following manner.

First, pull the sleeve portions 3 out of the trunk portion 2 and unite both fastener track 7 and fastener track 8 to close the first opening 6. Next, pull the head portion 4 out of the trunk portion 2 and engage the hooks 12 with the hooks 13. Now the article is ready to be used as a winter jacket.

Alternatively, disconnect track 7 from track 8, expand the first opening 6, receive the sleeve portion 3 in the trunk portion 2 through the expanded first opening 6 and then unite the tracks 8 and 10 to close the first opening 6. In the meanwhile, put the head portion 4 in the trunk 2 through the second opening 11 and then engage the hooks 14 with the hooks 13 to close the second opening 11. Now the trunk 2 is ready to be used as a bag for small articles.

After receiving articles in the trunk portion 2, draw out both end parts 19 of the string 17, allow them to pass through the loop member 22 and then anchor the engagement pieces 20 at the loop members 21. Now the article is ready to be used as a knapsack.

Figure 9:
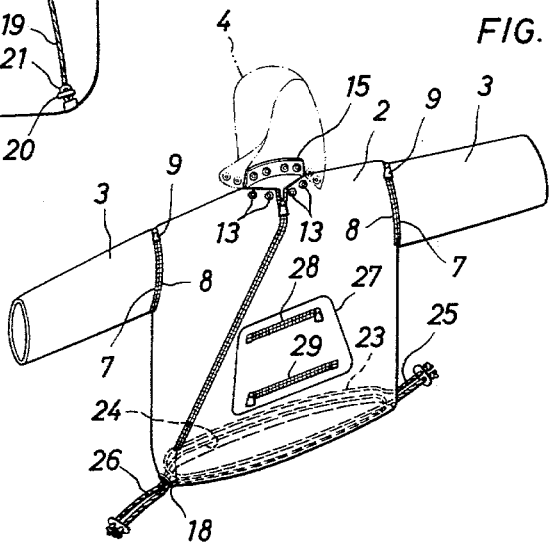
FIG. 9 is a perspective view of an outerwear in accordance with another embodiment of the present invention, wherein two lines of strings are used.
Figure 10:
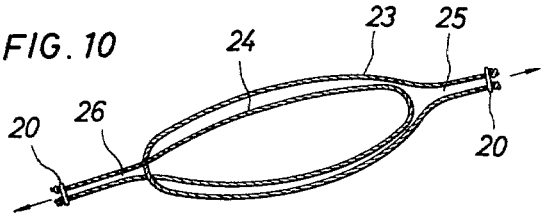
FIG. 10 is a perspective view showing the strings of FIG. 9.

The outerwear in accordance with the above described embodiment of the invention is such that a single line of string 17 extends through tube 18 and the both end parts 19 of the string 17 are drawn out from the central part of the trunk portion 2 at its bottom end. Alternatively, two lines of string 23 and 24 may extend through tube 18 and the both end parts 25 and 26 of the strings 23 and 24 may be drawn out from the both sides of the trunk portion 2, as illustrated in FIGS. 9 and 10.

Further the trunk portion 2 may be provided with a pouch 27 having upper and lower fasteners 28 and 29 extending in the horizontal direction, the fasteners 28 and 29 being or unzipped either from above or from below.

What is claimed is:

1. A convertible article useful as outerwear and a carrying bag, comprising:

a trunk portion adapted to fit over the torso of the wearer's body;

said portion including a back piece and side pieces forming the front of said article;

fastening means for closing said article;

armholes in said portion, and sleeves attached to said armholes and foldable in said trunk portion;

means for attaching said sleeves to said armholes and for closing said armholes;

a neck receiving opening at the upper part of said trunk portion for allowing passage of the wearer's head when said article is worn;

means for closing said neck receiving opening; and a device for pulling together said back and side pieces and locking said pieces to form a bag type enclosure when said trunk portion is inverted with said neck opening closed; and said armholes being closed with said sleeves withdrawn into said trunk portion and said front closed.

2. The article of claim 1, further including a head portion secured to said neck receiving opening and received therethrough into said trunk portion.

3. The article of claim 1 or 2, wherein said means for closing said neck opening includes:

a cover secured to said back piece; and said cover having fastening means and said neck opening having a front edge along the upper part of said side pieces provided with complementary fastening means.

4. The article of claim 1 or 2, wherein said device comprises:

a drawstring arranged about the bottom of said article, said drawstring having ends drawn out through the lower central part of said trunk portion, and pegs secured thereto; and said back piece having loop members in the upper and lower parts thereof adapted to cooperate with said pegs to lock said article when it is used as a bag.

5. The article of claim 1 or 2, including:

a tube formed in the lower part of said trunk portion and a pair of drawstrings in said tube; and said drawstrings, each having an end extending from both sides of said trunk portion and secured to a peg.

6. The article of claim 5, wherein:

said back piece has a pair of loop members in the upper part thereof and a single loop in the lower part thereof;

said drawstrings pass through said single loop; and said pegs are secured to said pair of loop members when said article is used as a bag.

7. The article of claim 1, wherein said fastening means for closing said front of said trunk portion includes continuous cooperating elements attached to said side pieces and extending from below said neck receiving portion to the bottom of said trunk portion.

8. The article of claim 7, wherein said fastening means extend along a bias on said side pieces, and one of said side pieces forming said front being larger than the other.

9. The article of claim 8, further including a pouch on said larger side piece.

* * * * *